US008978228B2

(12) United States Patent
Didehvar et al.

(10) Patent No.: US 8,978,228 B2
(45) Date of Patent: Mar. 17, 2015

(54) ADJUSTABLE ROD ASSEMBLY

(71) Applicant: Zenith Products Corporation, New Castle, DE (US)

(72) Inventors: Kaveh Didehvar, Hockessin, DE (US); Joseph Webb, Newark, DE (US); Alex Mikita, Haddonfield, NJ (US)

(73) Assignee: Zenith Products Corporation, New Castle, DE (US)

( * ) Notice: Subject to any disclaimer, the term of this patent is extended or adjusted under 35 U.S.C. 154(b) by 159 days.

(21) Appl. No.: 13/676,802

(22) Filed: Nov. 14, 2012

(65) Prior Publication Data

US 2014/0130331 A1 May 15, 2014

(51) Int. Cl.

| | |
|---|---|
| ***B23P 11/00*** | (2006.01) |
| ***A47H 1/022*** | (2006.01) |
| ***A47K 3/38*** | (2006.01) |

(52) U.S. Cl.

CPC . *A47H 1/022* (2013.01); *A47K 3/38* (2013.01)
USPC ..... 29/434; 211/123

(58) Field of Classification Search

USPC ..... 29/434, 455.1, 428; 211/123, 95, 96; 4/610, 596, 607, 608; 248/261, 263, 248/264, 265; D08/376

See application file for complete search history.

(56) References Cited

U.S. PATENT DOCUMENTS

| | | | |
|---|---|---|---|
| D19,582 | S | 1/1890 | Lau |
| 653,642 | A | 7/1900 | Darling |
| 839,959 | A | 1/1907 | Richards |
| 972,544 | A | 10/1910 | Lathrop |
| 1,253,486 | A | 1/1918 | Hammer |
| 1,481,730 | A | 1/1924 | Oakley |
| 1,502,154 | A | 7/1924 | Meuller |
| 1,675,111 | A | 6/1928 | Kenney |
| 1,679,881 | A | 8/1928 | Simpson |
| 1,721,305 | A | 7/1929 | Koering |
| 1,721,306 | A | 7/1929 | Koering |

(Continued)

FOREIGN PATENT DOCUMENTS

| | | | |
|---|---|---|---|
| CH | 625601 | A5 | 9/1981 |
| CN | 2221357 | Y | 3/1996 |

(Continued)

OTHER PUBLICATIONS

Office Action issued Dec. 14, 2012 in U.S. Appl. No. 13/269,108.

(Continued)

*Primary Examiner* — John C Hong
(74) *Attorney, Agent, or Firm* — Panitch Schwarze Belisario & Nadel LLP

(57) ABSTRACT

An adjustable rod assembly includes first and second rod assemblies, first and second end supports, and a tension rod mechanism. The first rod assembly has telescoping first, second and third tubes of generally straight configurations. The second tube of the first rod assembly is rotatable relative to the first and third tubes of the first rod assembly. The second rod assembly has telescoping first and second tubes. The third tube of the first rod assembly and the second tube of the second rod assembly are secured to the first end support. The respective first tubes of the first and second rod assemblies are secured to the second end support. The tension rod mechanism is fixedly secured within the second tube of the first rod assembly for rotational movement therewith, and has a threaded portion configured to extend into the first tube of the first rod assembly.

6 Claims, 4 Drawing Sheets

(56) References Cited

U.S. PATENT DOCUMENTS

| | | | | |
|---|---|---|---|---|
| D81,134 | S | | 5/1930 | Henderson |
| 1,837,340 | A | | 12/1931 | Schwartz |
| 1,951,660 | A | | 3/1934 | Klaudt |
| 1,953,450 | A | | 4/1934 | Thompson |
| 2,032,842 | A | | 3/1936 | Gould |
| 2,131,156 | A | | 9/1938 | Yardley |
| 2,150,204 | A | * | 3/1939 | Boye ..... 211/105.3 |
| D119,576 | S | | 3/1940 | Kirsch |
| 2,194,064 | A | | 3/1940 | Boye |
| 2,195,979 | A | | 4/1940 | Ziolkowski |
| 2,215,331 | A | | 9/1940 | Marsh |
| 2,219,075 | A | | 10/1940 | Veau |
| 2,250,003 | A | | 7/1941 | Boye |
| 2,263,698 | A | | 11/1941 | Hodgson |
| 2,293,168 | A | | 8/1942 | Pirone |
| 2,383,104 | A | | 8/1945 | Allen |
| 2,458,643 | A | | 1/1949 | Riley |
| 2,462,321 | A | | 2/1949 | Holmes |
| 2,519,996 | A | | 8/1950 | Blake |
| 2,562,371 | A | | 7/1951 | Shannon |
| 2,637,555 | A | | 5/1953 | Klaudt |
| 2,778,030 | A | | 1/1957 | Goche |
| 2,796,227 | A | | 6/1957 | Coakley |
| 2,915,327 | A | | 12/1959 | Kreske |
| 2,919,134 | A | | 12/1959 | Zuro |
| 2,927,762 | A | | 3/1960 | Owsiak |
| 2,974,806 | A | | 3/1961 | Seewack |
| 3,023,909 | A | | 3/1962 | Henry |
| 3,079,005 | A | | 2/1963 | Bednar |
| 3,107,361 | A | | 10/1963 | Glutting, Sr. |
| 3,418,665 | A | | 12/1968 | Long |
| 3,429,452 | A | | 2/1969 | Johnson |
| 3,493,121 | A | | 2/1970 | Doyle |
| 3,504,805 | A | | 4/1970 | Doyle |
| 3,521,758 | A | | 7/1970 | Guilfoyle, Sr. |
| 3,557,390 | A | | 1/1971 | Ruggles et al. |
| 3,572,511 | A | | 3/1971 | Triplett |
| 3,687,499 | A | | 8/1972 | Guilfoyle, Sr. |
| 3,864,760 | A | | 2/1975 | Bowen |
| D248,434 | S | | 7/1978 | Clivio et al. |
| 4,117,557 | A | | 10/1978 | McPeak et al. |
| 4,229,842 | A | | 10/1980 | Gilmore |
| 4,238,164 | A | | 12/1980 | Mazzolla |
| 4,329,076 | A | | 5/1982 | Coreth |
| 4,378,071 | A | | 3/1983 | Yakimicki |
| 4,399,917 | A | | 8/1983 | Ohman |
| 4,461,056 | A | | 7/1984 | Solinski |
| 4,496,059 | A | | 1/1985 | Leiter |
| 4,586,615 | A | | 5/1986 | Quitmann |
| 4,635,889 | A | | 1/1987 | Bell et al. |
| 4,636,106 | A | | 1/1987 | Waisbrod |
| 4,662,593 | A | | 5/1987 | Shames et al. |
| D293,297 | S | | 12/1987 | Wood |
| 4,754,504 | A | | 7/1988 | Cellini |
| 4,809,401 | A | | 3/1989 | Honig |
| D301,976 | S | | 7/1989 | Greenhut et al. |
| 4,895,471 | A | | 1/1990 | Geltz et al. |
| 4,979,713 | A | | 12/1990 | Bell |
| 5,022,104 | A | | 6/1991 | Miller |
| 5,056,753 | A | | 10/1991 | Lunau et al. |
| 5,103,531 | A | | 4/1992 | Perrotta |
| D327,421 | S | | 6/1992 | Pagan |
| 5,189,759 | A | | 3/1993 | Poore |
| 5,216,766 | A | | 6/1993 | Lang |
| 5,236,229 | A | | 8/1993 | Gonzalez |
| 5,242,065 | A | | 9/1993 | Hoban |
| 5,263,594 | A | | 11/1993 | Bianchi |
| 5,281,063 | A | | 1/1994 | Austin, III |
| D347,784 | S | | 6/1994 | Warshawsky |
| 5,330,061 | A | | 7/1994 | Geltz |
| 5,433,551 | A | | 7/1995 | Gordon |
| 5,477,964 | A | | 12/1995 | Hart |
| 5,484,056 | A | | 1/1996 | Wood |
| D374,167 | S | | 10/1996 | Scholl |
| 5,561,870 | A | | 10/1996 | Hertel |
| D376,312 | S | | 12/1996 | Cahn et al. |
| D377,753 | S | | 2/1997 | Meadows |
| 5,603,475 | A | | 2/1997 | Lim |
| D379,297 | S | | 5/1997 | Shires |
| 5,662,297 | A | | 9/1997 | Christensen et al. |
| D385,177 | S | | 10/1997 | Perry |
| 5,678,703 | A | | 10/1997 | Sawyer |
| D393,390 | S | | 4/1998 | Gottwald |
| D397,928 | S | | 9/1998 | Wise |
| 5,803,643 | A | | 9/1998 | Patelli et al. |
| 5,876,147 | A | | 3/1999 | Longo |
| 5,894,610 | A | | 4/1999 | Winter |
| D416,785 | S | | 11/1999 | Ming-Hsiao |
| D426,142 | S | | 6/2000 | Moore |
| D429,461 | S | | 8/2000 | Rowlay |
| 6,101,675 | A | | 8/2000 | Goldstein |
| D431,460 | S | | 10/2000 | Nichol |
| D438,462 | S | | 3/2001 | Nichol |
| 6,199,808 | B1 | | 3/2001 | Lin |
| 6,216,287 | B1 | | 4/2001 | Wise |
| 6,263,523 | B1 | | 7/2001 | Moore |
| 6,302,180 | B1 | | 10/2001 | Yu |
| 6,302,614 | B1 | | 10/2001 | Tseng |
| 6,305,558 | B1 | | 10/2001 | Bates |
| D466,399 | S | | 12/2002 | Jessee et al. |
| 6,543,629 | B1 | | 4/2003 | Samelson |
| 6,640,395 | B2 | | 11/2003 | Bush |
| 6,651,830 | B2 | | 11/2003 | Pan |
| 6,651,831 | B2 | | 11/2003 | Samelson |
| D483,251 | S | | 12/2003 | Suero, Jr. |
| 6,694,543 | B2 | | 2/2004 | Moore |
| 6,715,163 | B1 | | 4/2004 | Cunningham |
| D489,249 | S | | 5/2004 | Moore |
| 6,745,909 | B1 | | 6/2004 | Lai |
| D498,663 | S | | 11/2004 | Moore |
| 6,824,000 | B2 | | 11/2004 | Samelson |
| 6,845,955 | B1 | | 1/2005 | Hsu |
| 6,862,776 | B2 | | 3/2005 | Chen |
| 6,883,664 | B2 | | 4/2005 | Lee |
| D506,920 | S | | 7/2005 | Taylor |
| 6,913,156 | B1 | | 7/2005 | Wolff |
| 7,024,706 | B2 | | 4/2006 | Hess |
| D522,845 | S | | 6/2006 | Suero |
| D522,846 | S | | 6/2006 | Suero, Jr. |
| D522,847 | S | | 6/2006 | Suero, Jr. |
| 7,055,680 | B2 | | 6/2006 | Liebers |
| D525,115 | S | | 7/2006 | Harwanko |
| 7,076,815 | B2 | | 7/2006 | Orpilla |
| 7,111,336 | B1 | | 9/2006 | Lai |
| D534,062 | S | | 12/2006 | van den Bosch |
| D542,125 | S | | 5/2007 | Kaminski |
| D542,897 | S | | 5/2007 | Harwanko |
| D543,754 | S | | 6/2007 | Bauer et al. |
| D543,756 | S | | 6/2007 | Gilbert |
| D543,839 | S | | 6/2007 | Cooper et al. |
| D544,786 | S | | 6/2007 | Barrese |
| D547,165 | S | | 7/2007 | Barrese |
| D550,542 | S | | 9/2007 | Worrall et al. |
| D552,455 | S | | 10/2007 | Moore |
| 7,296,772 | B2 | | 11/2007 | Wang |
| D557,590 | S | | 12/2007 | Moore |
| D563,209 | S | | 3/2008 | Samelson |
| D563,526 | S | | 3/2008 | Bauer |
| 7,346,940 | B1 | | 3/2008 | Liao |
| D565,937 | S | | 4/2008 | Tsai |
| D567,637 | S | | 4/2008 | Moore |
| D576,022 | S | | 9/2008 | Goldstein |
| D577,991 | S | | 10/2008 | Chen |
| D586,647 | S | | 2/2009 | Didehvar |
| 7,512,997 | B2 | | 4/2009 | Dewees |
| 7,597,297 | B2 | | 10/2009 | Isfeld et al. |
| D618,542 | S | | 6/2010 | Bertken |
| 7,762,508 | B2 | | 7/2010 | Xu |
| D624,807 | S | | 10/2010 | Barrese |
| D624,808 | S | | 10/2010 | Krawczak et al. |
| 7,857,151 | B2 | | 12/2010 | Barrese |
| D631,273 | S | | 1/2011 | O'Brien et al. |
| D631,732 | S | | 2/2011 | Krawczak et al. |
| D633,780 | S | | 3/2011 | Barrese |

(56) References Cited

U.S. PATENT DOCUMENTS

| | | | | |
|---|---|---|---|---|
| D634,609 | S | 3/2011 | Bauer | |
| D636,660 | S | 4/2011 | O'Connell | |
| 7,926,127 | B2 | 4/2011 | Barrese | |
| 7,950,534 | B2 | 5/2011 | Kao | |
| D640,078 | S | 6/2011 | Gilbert | |
| 7,958,577 | B2 | 6/2011 | Chang | |
| 7,987,532 | B2 | 8/2011 | Bathurst et al. | |
| 7,987,534 | B2 | 8/2011 | Lin | |
| 7,997,428 | B2 | 8/2011 | Goldstein | |
| 8,015,633 | B2 | 9/2011 | Ho | |
| D648,619 | S | 11/2011 | Lowe | |
| D648,834 | S | 11/2011 | Gilbert | |
| 8,056,873 | B1 | 11/2011 | Hanley et al. | |
| D650,263 | S | 12/2011 | Barrese | |
| 8,069,507 | B2 | 12/2011 | Didehvar et al. | |
| 8,069,508 | B2 | 12/2011 | O'Connell | |
| 8,146,182 | B2 | 4/2012 | Bauer | |
| 8,185,981 | B2 | 5/2012 | Didehvar et al. | |
| 8,214,938 | B2 | 7/2012 | Hanley et al. | |
| 8,215,501 | B2 | 7/2012 | Trettin et al. | |
| 8,215,863 | B2 | 7/2012 | Sohn | |
| D667,295 | S | 9/2012 | Harwanko | |
| 8,297,870 | B2 | 10/2012 | Lenhart | |
| D671,395 | S | 11/2012 | Harwanko | |
| 8,341,775 | B2 * | 1/2013 | Didehvar | 4/608 |
| 8,505,129 | B2 | 8/2013 | Parker et al. | |
| 8,505,749 | B2 | 8/2013 | Trettin et al. | |
| 8,522,373 | B2 | 9/2013 | Bauer | |
| D691,030 | S | 10/2013 | Lindo et al. | |
| 8,800,072 | B2 | 8/2014 | Chang | |
| 8,827,587 | B2 | 9/2014 | Didehvar | |
| 8,851,305 | B2 | 10/2014 | Didehvar | |
| 2002/0084394 | A1 | 7/2002 | Barrett | |
| 2003/0034316 | A1 | 2/2003 | Kao | |
| 2003/0052070 | A1 | 3/2003 | Weisenburger | |
| 2004/0178310 | A1 | 9/2004 | Marion | |
| 2004/0182806 | A1 | 9/2004 | Figueroa | |
| 2005/0053423 | A1 | 3/2005 | Doubler et al. | |
| 2005/0230587 | A1 | 10/2005 | Yang | |
| 2005/0268394 | A1 | 12/2005 | Monk et al. | |
| 2006/0070177 | A1 | 4/2006 | Bathurst et al. | |
| 2006/0156465 | A1 | 7/2006 | Lavi et al. | |
| 2006/0218717 | A1 | 10/2006 | van den Bosch | |
| 2007/0006377 | A1 | 1/2007 | Moore | |
| 2007/0006378 | A1 | 1/2007 | Moore | |
| 2007/0174956 | A1 | 8/2007 | Heaslip | |
| 2008/0022451 | A1 | 1/2008 | Urlich et al. | |
| 2008/0028513 | A1 | 2/2008 | Didehvar | |
| 2008/0115265 | A1 | 5/2008 | Heaslip | |
| 2008/0184479 | A1 | 8/2008 | Bathurst | |
| 2008/0210827 | A1 | 9/2008 | Samelson | |
| 2008/0245486 | A1 | 10/2008 | Brown | |
| 2008/0245940 | A1 | 10/2008 | Brown | |
| 2008/0282464 | A1 | 11/2008 | Bauer | |
| 2008/0289096 | A1 | 11/2008 | Patel | |
| 2009/0083905 | A1 | 4/2009 | O'Connell | |
| 2009/0242713 | A1 | 10/2009 | Lowe et al. | |
| 2011/0011813 | A1 | 1/2011 | Kao | |
| 2011/0113547 | A1 | 5/2011 | O'Connell | |
| 2012/0005823 | A1 | 1/2012 | Baines | |
| 2012/0023657 | A1 | 2/2012 | Didehvar et al. | |
| 2012/0036628 | A1 | 2/2012 | O'Connell | |
| 2012/0110729 | A1 | 5/2012 | Baines | |
| 2012/0123896 | A1 | 5/2012 | Prodanovic et al. | |
| 2012/0152872 | A1 | 6/2012 | Didehvar | |
| 2012/0152873 | A1 | 6/2012 | Didehvar | |
| 2012/0152874 | A1 | 6/2012 | Didehvar | |
| 2012/0167368 | A1 | 7/2012 | Napier et al. | |
| 2012/0241399 | A1 | 9/2012 | Trettin et al. | |
| 2012/0261370 | A1 | 10/2012 | Chuang | |
| 2012/0284914 | A1 | 11/2012 | Bauer | |
| 2012/0285914 | A1 | 11/2012 | Carney | |
| 2014/0131298 | A1 * | 5/2014 | Didehvar et al. | 211/105.2 |

FOREIGN PATENT DOCUMENTS

| | | | |
|---|---|---|---|
| CN | 2228573 | Y | 6/1996 |
| CN | 2349932 | Y | 11/1999 |
| CN | 2566754 | Y | 8/2003 |
| CN | 2705648 | Y | 6/2005 |
| CN | 2835679 | Y | 11/2006 |
| CN | 2893271 | Y | 4/2007 |
| CN | 201001603 | Y | 1/2008 |
| CN | 201187499 | Y | 1/2009 |
| CN | 201189069 | Y | 2/2009 |
| CN | 201363343 | Y | 12/2009 |
| DE | 2051383 | A1 | 5/1971 |
| DE | 2460382 | C2 | 4/1986 |
| DE | 3539449 | A1 | 5/1987 |
| DE | 3539449 | C2 | 7/1992 |
| EP | 58405 | A1 | 8/1982 |
| EP | 58405 | B1 | 5/1985 |
| FR | 499003 | A | 1/1920 |
| FR | 2066283 | A5 | 8/1971 |
| GB | 1333384 | A | 10/1973 |
| GB | 2325397 | A | 11/1998 |
| GB | 2400813 | A | 10/2004 |
| GB | 2426693 | A | 12/2006 |
| JP | 2000-046021 | A | 2/2000 |
| JP | 2001-112561 | A | 4/2001 |
| JP | 2004-036803 | A | 2/2004 |
| JP | 2004-057213 | A | 2/2004 |

OTHER PUBLICATIONS

U.S. Appl. No. 13/752,724 by Lindo, filed Jan. 29, 2013.
Office Action issued Apr. 2, 2013 in U.S. Appl. No. 29/437,013.
U.S. Appl. No. 29/451,499 by Harwanko, filed Apr. 3, 2013.
U.S. Appl. No. 13/911,191 by Didehvar, filed Jun. 6, 2013.
Office Action issued Jun. 21, 2013 in U.S. Appl. No. 13/752,724 by Lindo.
Office Action issued Jul. 8, 2013 in U.S. Appl. No. 13/269,108 by Didehvar.
U.S. Appl. No. 29/480,312 by Vacarro, filed Jan. 24, 2014.
U.S. Appl. No. 14/258,546 by Vaccaro, filed Apr. 22, 2014.
Office Action issued Jul. 2, 2014 in U.S. Appl. No. 13/269,108 by Didehvar.
Office Action issued Oct. 4, 2013 in U.S. Appl. No. 13/268,712 by Didehvar.
Office Action issued Oct. 11, 2013 in U.S. Appl. No. 13/269,030 by Didehvar.
Office Action issued Nov. 29, 2013 in U.S. Appl. No. 13/268,712 by Didehvar.
Office Action issued Dec. 6, 2013 in U.S. Appl. No. 13/269,108 by Didehvar.
Office Action issued Dec. 27, 2013 in U.S. Appl. No. 13/752,724 by Lindo.
<http://plumbing.hardwarestore.com/51-283-shower-rods-and-holders/stanless-steel-curved-shower-rod-609421.aspx>; "Stanless Steel Curved Shower Rod, 1"×5""; web page printout date: Feb. 10, 2010; original web posting date: unknown, 1 page.
Office Action issued Jul. 8, 2011 in U.S. Appl. No. 11/833,044.
Office Action issued Dec. 11, 2012 in U.S. Appl. No. 29/381,234.
Notice of Allowance issued Jul. 24, 2012 in U.S. Appl. No. 29/422,283.
U.S. Appl. No. 29/398,880 by Lindo, filed Aug. 5, 2011.
Office Action issued Feb. 16, 2012 in U.S. Appl. No. 13/253,617.
U.S. Appl. No. 29/381,234 by Didehvar, filed Dec. 16, 2010.
U.S. Appl. No. 29/390,736 by Harwanko, filed Apr. 28, 2011.
U.S. Appl. No. 13/676,800 by Didehvar, filed Nov. 14, 2012.
Office Action issued Jul. 20, 2011 in U.S. Appl. No. 12/157,376.
Office Action issued Nov. 22, 2011 in U.S. Appl. No. 12/157,376.
U.S. Appl. No. 29/437,013 by Didehvar, filed Nov. 12, 2012.
U.S. Appl. No. 29/443,578 by Lindo, filed Jan. 18, 2013.
<http://www.amazon.com/Polder-Radial-Duo-Shower-Rod/dp/B001CEONRY>; Polder Radial Duo Shower Rod, web page printout date: Jun. 2, 2011; original web posting date and product availability date: unknown, 3 pages.

(56) References Cited

OTHER PUBLICATIONS

Photographs of Tension Rod With End Cap and Cover (1)—Date Unknown—Admitted Prior Art as of at least Nov. 13, 2011.
Photographs of Tension Rod With End Cap and Cover (2)—Date Unknown—Admitted Prior Art as of at least Nov. 13, 2011.
Three photographs of Maytex Mills "Ez-Up" tension rod (date unknown) (admitted prior art as of at least Nov. 13, 2011).
"Masterform Tool Company; Clevis Brackets", web page printout date: Feb. 11, 2010; original web posting date and product availability date: unknown, 1 page. (admitted prior art as of at least Nov. 13, 2011), retrieved from: http://www.masterformtool.com/catalog.asp?category=2&class=11&subclass=0&part=0.
"Medium—to Heavy-Duty Repairable Cylinders", Aro-20546 Clevis Bracket, SKU—40769, web page printout date: Feb. 11, 2010; original web posting date: unknown, 1 page. (admitted prior art as of at least Nov. 13, 2011), retrieved from: http://www.drillspot.com/products/40400/ingersoll-rand_20547_clevis_bracket.
"Clevis Bracket, Material: Forging, Weldment, or Ductile Iron", web page printout date: Feb. 11, 2010; original web posting date: unknown, 1 page. (admitted prior art as of at least Nov. 13, 2011), retrieved from: http://www.aggressivehydraulics.com/products/cylinder-component-parts/mounts/.
JCPenney, "Curved Smart Shower Rod" (admitted prior art as of at least Nov. 13, 2011), retrieved from http://www.jcpenney.com/curved-smart-shower-curtain-rod/prod.jump?ppId=pp5002324584&cmvc=JCP|dept20000012|cat100250092|RICHREL&grView=&eventRootCatId=&currentTabCatId=&regId=.
Photograph of Curved Shower Rod by Hardware Resources (admitted prior art as of at least Nov. 13, 2011).
Photograph of a curved shower rod distributed by Popular Bath Products, Inc. (admitted prior art as of at least Nov. 13, 2011).
U.S. Appl. No. 14/465,370 by Didehvar, filed Aug. 21, 2014.
U.S. Appl. No. 14/465,355 by Didehvar, filed Aug. 21, 2014.
U.S. Appl. No. 14/522,226 by Walker, filed Oct. 23, 2014.
U.S. Appl. No. 29/506,250 by Walker, filed Oct. 14, 2014.
Office Action issued Aug. 20, 2014 in U.S. Appl. No. 13/911,191 by Didehvar.
Office Action issued Nov. 6, 2014 in U.S. Appl. No. 14/465,355 by Didehvar.
Office Action issued Jan. 7, 2015 in U.S. Appl. No. 14/465,355 by Didehvar.
English translation of an Office Action issued Dec. 9, 2014 in CN Application No. 201110461894.0.

* cited by examiner

ADJUSTABLE ROD ASSEMBLY

BACKGROUND OF THE INVENTION

An embodiment of the present invention relates generally to an adjustable rod assembly, and more particularly, to an adjustable tension-mounted dual rod assembly.

Adjustable length tension-mounted rods for use as curtain or shower curtain rods are generally known. These tension-mounted rods typically include a single straight rod having a first straight shaft that telescopingly receives a second straight shaft, wherein the first and second shafts house a long threaded stud. Dual rod assemblies, such as those having a curved shower curtain rod, however, typically require the use of screws, bolts, and the like in order to permanently fix the curved rod to support surfaces through. This results in dual rod assemblies being more complex to install and the risk of permanently damaging the support surfaces upon removal of the assembly.

It is therefore desirable to provide an adjustable dual rod assembly that is mounted between opposing support surfaces by a tension rod mechanism, thereby providing for simpler installation of the assembly and reducing, if not eliminating, the risk of damage to the support surfaces upon removal of the assembly.

BRIEF SUMMARY OF THE INVENTION

Briefly stated, one embodiment of the present invention is directed to an adjustable rod assembly comprising a first rod assembly having a first tube of a generally straight configuration, a second tube of a generally straight configuration, and a third tube of a generally straight configuration. A first end of the first tube is telescopingly received within the second tube and a first end of the second tube is telescopingly received within the third tube. The second tube is rotatable relative to the first tube and the third tube. The adjustable rod assembly further comprises a second rod assembly having a first tube and a second tube. A first end of the first tube is telescopingly received within the second tube. The adjustable rod assembly further comprises a first end support, a second end support, and a tension rod mechanism fixedly secured within the second tube of the first rod assembly for rotational movement therewith. The third tube of the first rod assembly and the second tube of the second rod assembly are secured to the first end support. The respective first tubes of the first and second rod assemblies are secured to the second end support. The tension rod mechanism has a threaded portion configured to extend into an interior of the first tube of the first rod assembly.

Another embodiment of the present invention is directed to a method of installing an adjustable rod assembly. The method comprises: (a) providing an adjustable rod assembly including a first straight rod assembly having a first straight tube and a second straight tube, a second curved rod assembly having a first arcuate tube and a second arcuate tube, and first and second end supports, wherein each of the first and second straight tubes and each of the first and second arcuate tubes has opposing first and second ends; (b) assembling the adjustable rod assembly by: (i) telescopingly positioning the first end of the first straight tube in the second end of the second straight tube and telescopingly positioning the first end of the first arcuate tube in the second end of the second arcuate tube, (ii) pivotably securing the second end of the first straight tube and the second end of the first arcuate tube to the second end support, (iii) pivotably securing the first end of the second arcuate tube to the first end support, and (iv) rotatably securing the first end of the second straight tube to the first end support; c) positioning the assembled adjustable rod assembly between opposing support surfaces; d) adjusting a length of the assembled adjustable rod assembly such that a respective rear surface of each of the first and second end supports is proximate a respective one of the opposing support surfaces; and e) rotating the second straight tube about a longitudinal axis thereof until the respective rear surface of each of the first and second end supports directly contacts a respective one of the opposing support surfaces and the assembled adjustable rod assembly applies a compressive force against the opposing support surfaces.

In another embodiment, the present invention is directed to an adjustable tension rod assembly comprising a first straight rod assembly and a second curved rod assembly. The first straight rod assembly includes a first straight tube having a first end and a second end, a second straight tube having a first end and a second end, and a third straight tube having a first end and a second end. The second end of the first straight tube is telescopingly received within the second end of the second straight tube and the second straight tube is rotatable relative to the first straight tube. The first end of the second straight tube is rotatably and telescopingly received within the second end of the third straight tube. The second curved rod assembly includes a first arcuate tube having a first end and a second end and a second arcuate tube having a first end and a second end. The first end of the first arcuate tube is telescopingly received within the second end of the second arcuate tube. The adjustable tension rod assembly further comprises a first end support, a second end support, and a tension mechanism including a rod with a connector and a threaded portion. The first end of the third straight tube and the first end of the second arcuate tube are pivotably secured to the first end support at spaced apart positions. The second end of the first straight tube and the second end of the first arcuate tube are pivotably secured to the second end support at spaced apart positions. The connector of the tension mechanism is fixedly secured within the first end of the second straight tube and rotatably secured within the third straight tube. The threaded portion of the tension mechanism is rotatably secured within the first straight tube by a threaded bushing. Rotation of the second straight tube in a first direction about a longitudinal axis of the second straight tube causes the first and third straight tubes to move away from each other and causes the first and second arcuate tubes to move away from each other. Rotation of the second straight tube in a second opposite direction about the longitudinal axis of the second straight tube causes the first and third straight tubes to move toward each other and causes the first and second arcuate tubes to move toward each other.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
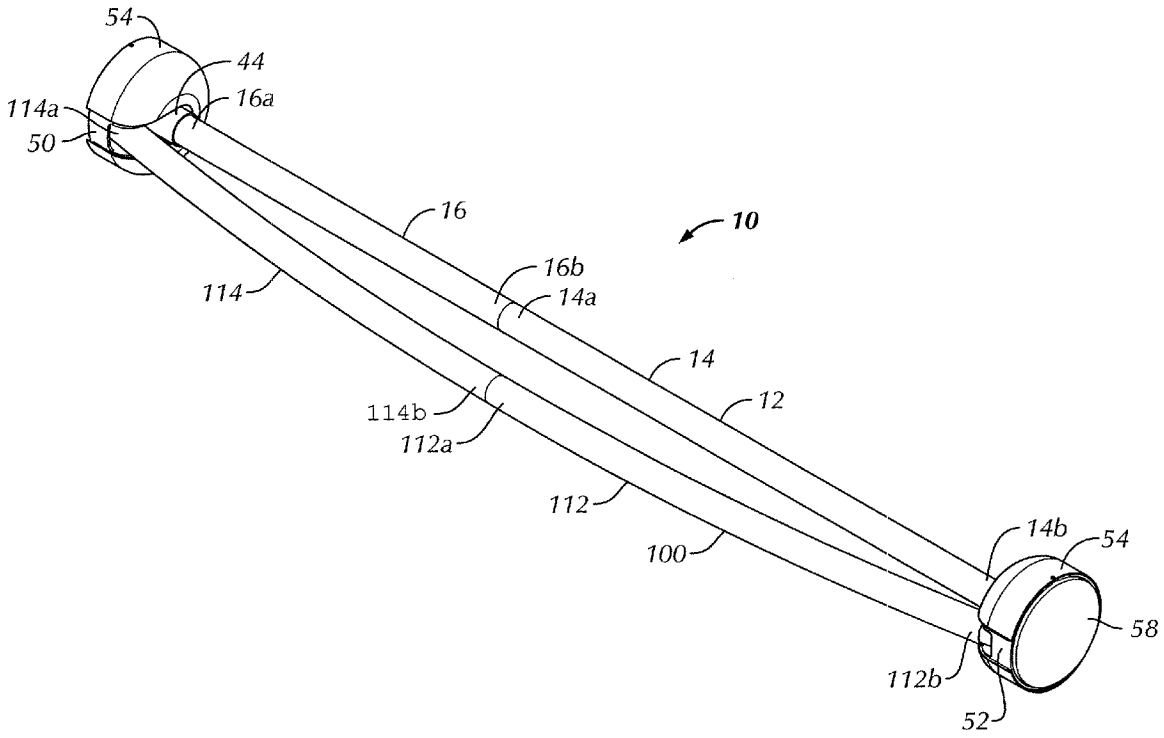
FIG. 1 is a left perspective view of an adjustable rod assembly in accordance with a preferred embodiment of the present invention.

Certain terminology is used in the following description for convenience only and is not limiting. The words "right," "left," "top," "bottom" and "lower" designate directions in the drawings to which reference is made. The words "first," "second," "third" and "fourth" designate an order of operations in the drawings to which reference is made, but do not limit these steps to the exact order described. The words "inwardly" and "outwardly" refer to directions toward and away from, respectively, the geometric center of the device and designated parts thereof. Unless specifically set forth herein, the terms "a," "an" and "the" are not limited to one element, but instead should be read as meaning "at least one." The terminology includes the words noted above, derivatives thereof and words of similar import.

Figure 2A:
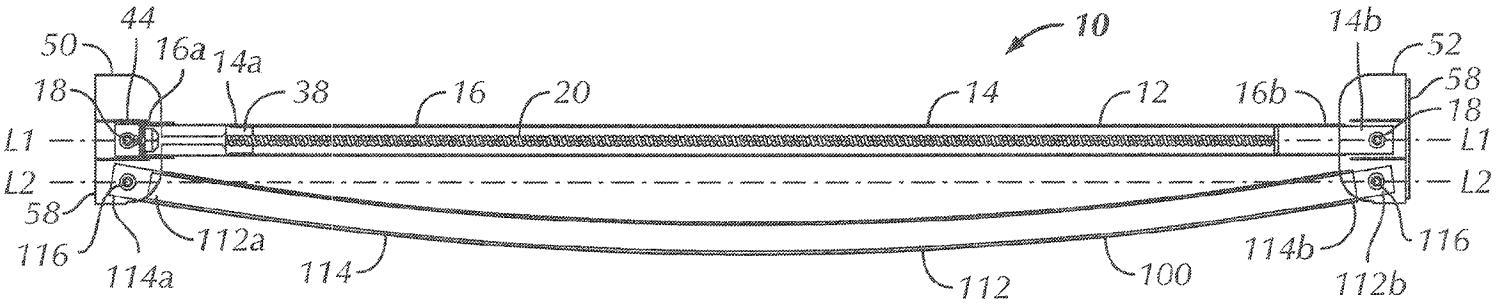
FIG. 2A is a top plan partial cross-sectional view of the adjustable rod assembly shown in FIG.
Figure 2B:
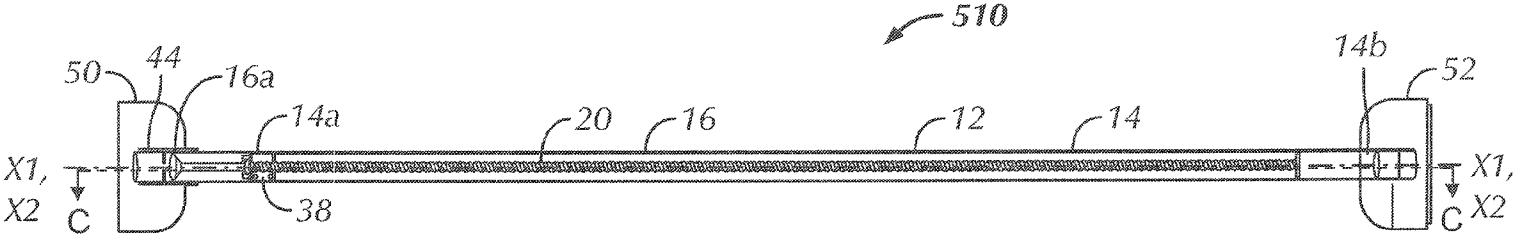
FIG. 2B is a rear plan partial cross-sectional view of the adjustable rod assembly shown in FIG. 1.

Referring to the drawings in detail, wherein like numerals and characters indicate like elements throughout, there is shown in FIGS. 1-2B a presently preferred embodiment of an adjustable tension-mounted rod assembly 10 in accordance with the present invention. With reference initially to FIG. 1, the adjustable tension-mounted rod assembly preferably functions as an adjustable dual curtain rod assembly, generally designated 10.

With particular reference to FIGS. 1-2B, the adjustable rod assembly 10 can be secured between two opposing support surfaces (not shown), such as bathroom walls. The adjustable rod assembly 10 can be used as a dual shower curtain rod assembly, or as a standard dual curtain rod assembly. The adjustable rod assembly 10 comprises a first generally straight rod assembly 12 and a second generally curved rod assembly 100, both of which are positioned between the two opposing support surfaces. However, it will be understood by those skilled in the art that the adjustable rod assembly 10 may comprise only one straight or curved rod assembly 12, 100, two generally straight rod assemblies 12, or two generally curved rod assemblies 100.

The curved rod assembly 100 comprises a first, inner tube 112 having an arcuate portion and a second, outer tube 114 having an arcuate portion. The first, inner arcuate tube 112 has a first end 112*a* and a second end 112*b*. The second, outer arcuate tube 114 has a first end 114*a* and a second end 114*b*. The first end 114*a* of the second arcuate tube 114 and the second end 112*b* of the first arcuate tube 112 are each provided with a pair of diametrically opposed apertures 116 (see FIG. 2). The first and second arcuate tubes 112, 114 are preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The first and second arcuate tubes 112, 114 may also be coated with any type of known coating for applying a non-corrosive finish to the curved rod assembly 100.

The first and second arcuate tubes 112, 114 are both preferably generally cylindrical in shape with a circular cross section. However, it will be understood by those skilled in the art that any other suitable cross-sectional shape may be used, including oval, square, rectangular, hexagonal, octagonal, and the like. Preferably, the outer diameter of the first arcuate tube 112 is at least slightly smaller than the inner diameter of the second arcuate tube 114, such that first arcuate tube 112 is telescopingly received within the second arcuate tube 114 in a reasonably tight fit. More particularly, in an assembled position of the adjustable rod assembly 10, the first end 112*a* of the first arcuate tube 112 is telescopingly positioned or received within the second end 114*b* of the second arcuate tube 114. Accordingly, the first and second arcuate tubes 112, 114 of the curved rod assembly 100 are telescopingly configured.

The straight rod assembly 12 comprises a first, inner tube 14 of a generally straight configuration and a second, outer tube 16 of a generally straight configuration. The first, inner straight tube 14 has a first end 14*a* and a second end 14*b*. The second, outer straight tube 16 has a first end 16*a* and a second end 16*b*. The second end 14*b* of the first straight tube 14 is provided with a pair of diametrically opposed apertures 18. The first and second straight tubes 14, 16 are preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The first and second straight tubes 14, 16 may also be coated with any type of known coating for applying a non-corrosive finish to the straight rod assembly 12.

The first and second straight tubes 14, 16 are both preferably generally cylindrical in shape with a circular cross section. However, it will be understood by those skilled in the art that any other suitable cross-sectional shape may be used, including oval, square, rectangular, hexagonal, octagonal, and the like. Preferably, the outer diameter of the first straight tube 14 is at least slightly smaller than the inner diameter of the second straight tube 16, such that first straight tube 14 is telescopingly received within the second straight tube 16 in a reasonably tight fit. More particularly, in an assembled position of the adjustable rod assembly 10, the first end 14*a* of the first straight tube 14 is telescopingly positioned or received within the second end 16*b* of the second straight tube 16. Accordingly, the first and second straight tubes 14, 16 of the straight rod assembly 12 are telescopingly configured.

The second straight tube 16 of the straight rod assembly 12 is preferably a rotatable tube. More particularly, the second straight tube 16 of the straight rod assembly 12 is preferably rotatable about a longitudinal axis X1 thereof. Further, in the assembled position of the adjustable rod assembly 10, the longitudinal axis X1 of the second straight tube 16 of the straight rod assembly 12 is preferably generally aligned with the longitudinal axis X2 of the first straight tube 14 of the straight rod assembly 12. As such, in the assembled position of the adjustable rod assembly 10, the second straight tube 16 is preferably freely rotatable relative to the first straight tube 14 positioned therein.

Figure 2C:
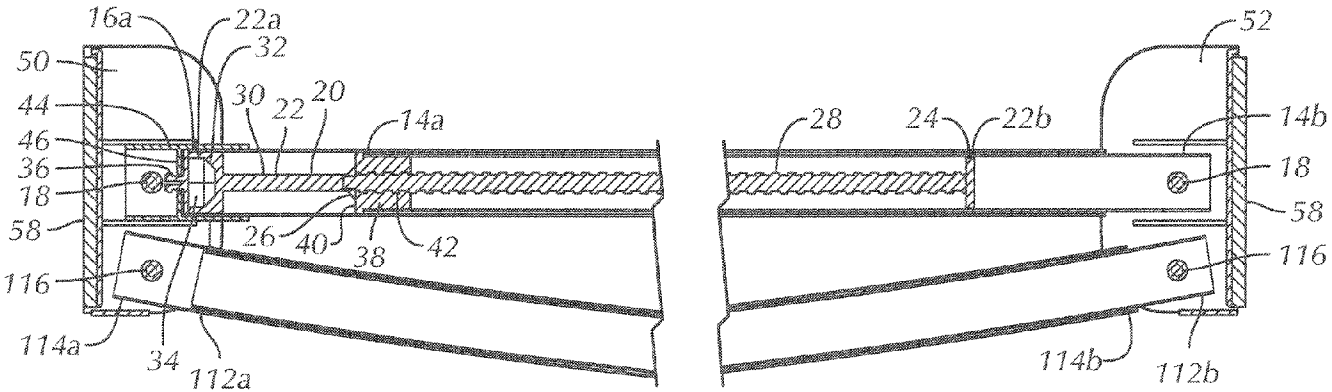
FIG. 2C is an enlarged and partial top plan cross-sectional view of the adjustable rod assembly shown in FIG. 1.

Preferably, the first and second straight tubes 14, 16 are each at least partially hollow, such that a tension mechanism 20 can be fitted therein (see FIGS. 2A-2C). More specifically, the tension mechanism 20 is fixedly secured within an interior of the second straight tube 16, and more preferably within the first end 16*a* of the second straight tube 16, such that the tension mechanism 20 is configured to rotate with the second straight tube 16. U.S. Pat. No. 5,330,061, which is assigned to Zenith Products Corp. and is incorporated herein by reference, describes a preferred embodiment of a tension mechanism of the type for use in the adjustable rod assembly 10.

Specifically, referring to FIG. 2C, the tension mechanism 20 of the straight rod assembly 12 is preferably a tension rod mechanism 20 comprising a rod 22 having a first end 22*a*, a second end 22*b*, a first stop piece 24 and a second stop piece 26. The first stop piece 24 is provided at the first end 22*a* of the rod 22, while the second stop piece 26 is positioned in between the first and second ends 22*a*, 22*b*. The first and second stop pieces 24, 26 may be shaped differently, as shown in FIG. 2C, or alternatively may have substantially identical structures. As will be discussed more fully herein, the first and second stop pieces 24, 26 define the limits to which the overall length of the adjustable rod assembly 10 can be adjusted.

The rod 22 comprises a threaded portion 28, an unthreaded portion 30 and a connector portion 32. The threaded portion 28 of the rod 22 is defined by the portion of the rod 22 having an external thread pattern. Preferably, at least one part of the threaded portion 28 of the rod 22 is flexible. More preferably, the entirety of the threaded portion 28 of the rod 22 is flexible. However, it will be understood by those skilled in the art that a portion or the entirety of the threaded portion 28 of the rod 22 may alternatively be generally rigid. In one embodiment, as shown in FIG. 2C, the threaded portion 28 of the rod 22 extends from the second end 22*b* of the rod 22 and the first stop piece 24 to the second stop piece 26.

The connector portion 32 of the rod 22 preferably comprises a connector 34 which defines the first end 22*a* of the rod 22. At a distal tip of the connector 34, a locking pin 36 is integrally formed with the connector 34. However, it will be understood that the locking pin 36 may be formed as a separate component which is secured to the connector 34 by any conventional means. The locking pin 36 protrudes outwardly from a surface of the connector 34 and also from the threaded and unthreaded portions 28, 30 of the rod 22.

The unthreaded portion 30 of the rod 22 extends from the second stop piece 26 to the connector 34 at the first end 22*a* of the rod 22. Preferably, at least one part of the unthreaded portion 30 of the rod 22 is flexible. More preferably, the entirety of the unthreaded portion 30 of the rod 22 is flexible. However, it will be understood by those skilled in the art that a portion or the entirety of the unthreaded portion 30 of the rod 22 may alternatively be generally rigid.

In the assembled position of the adjustable rod assembly 10, the first end 14*a* of the first straight tube 14 is telescopingly positioned within the interior of the second straight tube 16, and the first end 112*a* of the first arcuate tube 112 is telescopingly positioned within the interior of the second arcuate tube 114. Further, the connector portion 32 of the tension mechanism 20 is fixedly secured within the first end 16*a* of the second straight tube 16 and at least a portion of the threaded portion 28 of the rod 22 extends into and is rotatably secured within the first straight tube 14. More preferably, the connector 34 of the rod 22 is fixedly secured within the first end 16*a* of the second straight tube 16, the unthreaded portion 30 of the rod 22 is positioned within an interior of the second straight tube 16, and at least a portion of the threaded portion 28 of the rod 22 extends into an interior of the first end 14*a* of the first straight tube 14. Accordingly, rotation of the second straight tube 16 about the longitudinal axis X1 thereof, relative to the first straight tube 14, also causes rotation of the rod 22 of the tension mechanism 20 relative to the first straight tube 14.

In one embodiment, at least a portion of an interior surface of the first end 14*a* of the first straight tube 14 preferably includes a threaded portion which is configured to threadingly engage the threaded portion 28 of the rod 22 to rotatably secure the rod 22 within the first straight tube 14. In another embodiment, the interior of the first end 14*a* of the first straight tube 14 preferably includes a threaded bushing or nut 38 configured to threadingly engage the threaded portion 28 of the rod 22 to rotatably secure the rod 22 therein. The threaded bushing 38 is preferably fixedly secured within the first end 14*a* of the first straight tube 14. More preferably, the threaded bushing 38 is positioned at substantially a distal-most tip of the first end 14*a* of the first straight tube 14. However, it will be understood by those skilled in the art that the threaded bushing 38 may be positioned at some other location within the first straight tube 14, as long as the location allows extension and collapse of the adjustable rod assembly 10 to the desired length.

The threaded bushing 38 is preferably made from a metal, such as cold-rolled steel, stainless steel, aluminum, chrome or nickel or alloys or combinations thereof, but may also be constructed using wood, plastic, acrylic, or a like strong, lightweight material or a combination of materials. The threaded bushing 38 may be secured within the first straight tube 14 by any conventional means, such as a flange connection, a dimple connection, adhesives, welds and the like. Preferably, the threaded bushing 38 is secured within the first end 14*a* of the first straight tube 14 by a flange 40 which extends circumferentially from the threaded bushing 38 around at least a portion of the distal-most tip of the first end 14*a* of the first straight tube 14.

Preferably, an exterior surface of the threaded bushing 38 is in direct contact with an interior surface of the first straight tube 14. An interior surface of the threaded bushing 38 is preferably defined by a centrally located and threaded through-hole 42. The thread pattern of the through-hole 42 corresponds to or complements that of the threaded portion 28 of the rod 22. The centrally located through-hole 42 of the threaded bushing 38 also includes an inner diameter that is substantially equal to the outer diameter of the threaded portion 28 of the rod 22. Accordingly, in the assembled position of the adjustable rod assembly 10, and more particularly in the assembled position of the straight rod assembly 12, the threaded portion 28 of the rod 22 is positioned within the centrally located through-hole 42 of the threaded bushing 38, such that the threaded portion 28 of the rod 22 rotates within the threaded bushing 38.

Preferably, rotation of the second straight tube 16 causes the first straight tube 14 and the second straight tube 16 to move axially relative to each other. More particularly, rotation of the second straight tube 16 in a first direction about the longitudinal axis X1 thereof preferably causes the first straight tube 14 and the second straight tube 16 move away from each other, thereby extending a length L1 of the straight rod assembly 12. Rotation of the second straight tube 16 in the first direction, and more particularly movement of the threaded portion 28 within the threaded bushing 38 as the second straight tube 16 is rotated in the first direction, is preferably limited by the second stop piece 26.

Rotation of the second straight tube 16 in a second direction, opposite the first direction, about the longitudinal axis X1 thereof preferably causes the first straight tube 14 and the second straight tube 16 to move axially toward each other, thereby reducing the length L1 of the straight rod assembly 12. Rotation of the second straight tube 16 in the second direction, and more particularly movement of the threaded portion 28 within the threaded bushing 38 as the second straight tube 16 is rotated in the second direction, is preferably limited by the first stop piece 24.

Figure 3A:
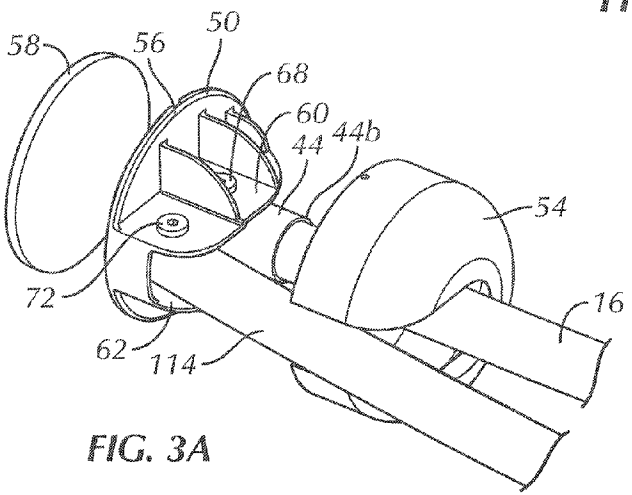
FIG. 3A is an enlarged front perspective view of one end of the adjustable rod assembly shown in FIG. 1.
Figure 3B:
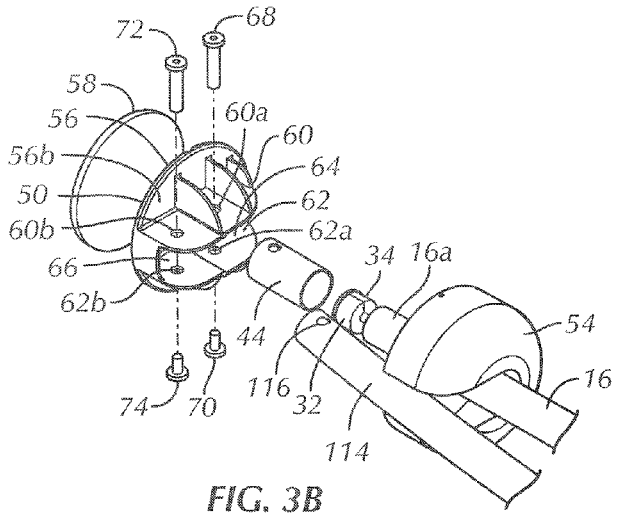
FIG. 3B is an exploded front perspective view of one end of the adjustable rod assembly shown in FIG. 1.
Figure 3C:
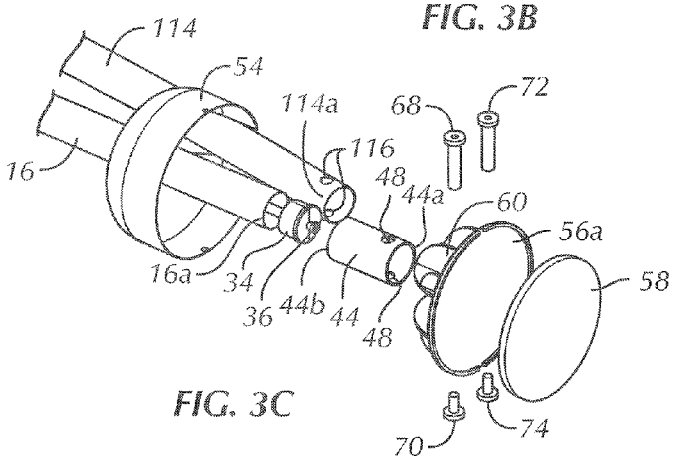
FIG. 3C is an exploded rear perspective view of one end of the adjustable rod assembly shown in FIG. 1.
Figure 4:
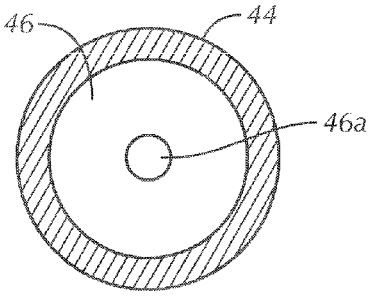
FIG. 4 is an enlarged elevational cross-sectional view of a third tube of the straight rod assembly of the adjustable rod assembly shown in FIG. 1.

Referring, to FIGS. 3A-3C, the straight rod assembly 12 further comprises a third tube 44 which is preferably generally cylindrical in shape with a circular cross section and which preferably has a generally straight configuration. The third tube 44 is preferably a generally cylindrical coupler 44. The coupler 44 has a first end 44*a* and a second end 44*b*. Referring to FIG. 4, in one embodiment, the coupler 44 preferably includes at least one generally closed interior and intermediate wall 46 (see FIG. 4) at a position between the opposing first and second ends 44*a*. 44*b*. Preferably, the interior and intermediate wall 46 includes an aperture or groove 46*a* formed therein. More preferably, the interior and intermediate wall 46 includes a centrally-located aperture 46*a* formed therethrough. The first end 44*a* of the coupler 44 preferably includes a pair of diametrically opposed apertures 48.

The inner diameter of the coupler 44 is at least slightly larger than the outer diameter of the second straight tube 16, such that the second straight tube 16 can be positioned within an interior of the coupler 44. More particularly, in the assembled position of the adjustable rod assembly 10, the first end 16*a* of the second straight tube 16 of the straight rod assembly 12 is telescopingly positioned and received within the second end 44*b* of the coupler 44. Preferably, the second straight tube 16 is rotatably secured within the coupler 44, such that the second straight tube 16 is freely rotatable relative to the coupler 44.

In one embodiment, the preferred structural configuration of the second straight tube 16 and the coupler 44 is achieved by rotational engagement of the locking pin 36 and the aperture or groove 46*a* of the intermediate wall 46 of the coupler 44. More particularly, in one embodiment, the first end 16*a* of the second straight tube 16, in which the connector 34 of the tension mechanism 20 is fixedly secured, is positioned within the second end 44*b* of the coupler 44 until the locking pin 36 of the connector 34 passes through the aperture 46*a* of the intermediate wall 46. Preferably, at least a portion of the locking pin 36 has a diameter which is at least slightly larger than that of the aperture 46*a*, such that once the locking pin 36 is positioned within the aperture 46*a* (e.g., by snapping the locking pin 36 into position), the locking pin 36 is frictionally engaged by the aperture 46*a* and is not easily detached or removed from the aperture 46*a*.

Such an engagement between the tension mechanism 20 and the coupler 44 secures the tension mechanism 20 to the coupler 44 in a stable manner, while simultaneously enabling both the second straight tube 16 and the tension mechanism 20 to rotate relative to the coupler 44 and the first straight tube 14, as necessary for adjustment of the overall length of the adjustable rod assembly 10 and the generation of a tensile or compressive force which holds the adjustable rod assembly 10 in place between opposing supporting surfaces. More particularly, rotation of the second straight tube 16 in the first direction about the longitudinal axis X1 thereof preferably causes the first straight tube 14 and the coupler 44 to move away from each other, thereby extending the overall length of the straight rod assembly 12, as well as that of the curved rod assembly 100 and the adjustable rod assembly 10. Conversely, rotation of the second straight tube 16 in the second, opposite direction about the longitudinal axis X1 thereof preferably causes the first straight tube 14 and the coupler 44 to move toward each other, thereby reducing the length L1 of the straight rod assembly 12, as well as that of the curved rod assembly 100 and the adjustable rod assembly 10.

The coupler 44 is preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The coupler 44 may also be coated with any type of known coating for applying a non-corrosive finish to the coupler 44. More preferably, the coupler 44 is made from the same material as the first and second tubes 14, 16.

The adjustable rod assembly 10 further comprises a first end support 50 and a second end support 52. Each of the first and second end supports 50, 52 is configured to be removably mounted to a respective support surface (not shown) of the two opposing support surfaces. The coupler 44 of the straight rod assembly 12 and the first end 114*a* of the second arcuate tube 114 are both secured to the first end support 50. The second end 14*b* of the first straight tube 14 and the second end 112*b* of the first arcuate tube 112 are both secured to the second end support 52.

The first end and second end supports 50, 52 are preferably made from a lightweight, high strength material, such as cold-rolled steel, stainless steel, aluminum, chrome or nickel or alloys or combinations thereof, but may also be constructed using wood, plastic, acrylic, or a like strong, lightweight material or a combination of materials, without departing from the spirit and scope of the invention. Preferably, the first and second end supports 50, 52 are made from the same material as the straight rod assembly 12 and the curved rod assembly 100. One or both of the first and second end supports 50, 52 may optionally be provided with a decorative cover 54.

The first end support 50 is preferably a mirror image of the second end support 52. For convenience in the description and clarity in the drawings, only the first end support 50 is described in detail and completely labeled in the drawings with the understanding that the second end support 52 includes similar features.

Referring to FIGS. 3A-3C, the first end support 50 includes a base plate 56 having a first, rear face 56*a* and an opposing second, front face 56*b*. Preferably, a resilient pad 58 is secured to the rear surface 56*a* of the base plate 56 and is configured to directly contact one of the opposing support surfaces to support the adjustable rod assembly 10 above a ground surface when the assembly is installed. The resilient pad 58 may be made of a rubber (natural or synthetic), foam, an elastomeric plastic or any other resilient material having a sufficiently high coefficient of friction to ensure secure mounting of the adjustable rod assembly 10 between the two opposing support surfaces.

A first flange 60 and a second flange 62 extend generally perpendicularly from the front face 56*b* of the base plate 56 of the first end support 50. The first and second flanges 60, 62 are spaced apart from each other so as to form a first support area 64 and a second support area 66 therebetween. Preferably, the first support area 64 is spaced apart from the second support area 66. A first aperture 60*a* and a second aperture 60*b* are formed in the first flange 60. A first aperture 62*a* and a second aperture 62*b* are formed in the second flange 62. Preferably, the respective first apertures 60*a*, 62*a* of the first and second flanges 60, 62 are generally aligned or in registry with each other and the first support area 64 is formed therebetween. Preferably, the respective second apertures 60*b*, 62*h* of the first and second flanges 60, 62 are generally aligned or in registry with each other and the second support area 66 is formed therebetween.

In one embodiment, the straight rod assembly 12 is secured between and to the first support areas 64 of the first and second end supports 50, 52. Specifically, the first support area 64 of the first end support 50 preferably receives the first end 44*a* of the coupler 44 of the straight rod assembly 12 in a stable manner, and the first support area 64 of the second end support 52 preferably receives the second end 14*h* of the first straight tube 14 of the straight rod assembly 12 in a similarly stable manner.

In one embodiment, a first fastener assembly comprising a first fastening pin 68 and a first fastening pin end 70 is utilized to secure the coupler 44 within the first support space 64 formed between the first and second flanges 60, 62 of the first end support 50. Specifically, in the assembled position of the adjustable rod assembly 10, the first end 44*a* of the coupler 44 is positioned within the first support space 64, such that the apertures 48 of the first end 44*a* of the coupler 44 are generally aligned or in registry with the respective first apertures 60*a*, 62*a* of the first and second flanges 60, 62. The first fastening pin 68 and the first fastening pin end 70 are then inserted through the respective first apertures 60*a*, 62*a* of the first end support 50 and the apertures 48 of the coupler 44. The first fastening pin 68 may be secured within the first fastening pin end 70 by any known conventional mechanisms, such as corresponding thread patterns, an adhesive, friction fit, an interference fit and the like. As such, the coupler 44, and more particularly the first end 44*a* of the coupler 44, is pivotably secured to the first end support 50. However, it will be understood by those skilled in the art that the coupler 44 may alternatively be fixedly secured to the first end support 50.

Preferably, the second end 14*b* of the first straight tube 14 is pivotably secured to the first support area 64 of the second end support 52 in a similar manner. Specifically, a second fastening pin and a second fastening pin end of a second fastening assembly (not shown) engage the respective first apertures 60*a*, 62*a* of the first and second flanges 60, 62 of the second end support 52 and the apertures 18 of the second end 14*b* of the first straight tube 14 to pivotably secure the first straight tube 14 to the second end support 52. However, it will be understood by those skilled in the art that the second end 14*b* of the first straight tube 14 may alternatively be fixedly secured to the second end support 52.

In one embodiment, the curved rod assembly 100 is secured between and to the second support areas 66 of the first and second end supports 50, 52. Specifically, the second support area 66 of the first end support 50 preferably receives the first end 114*a* of the second arcuate tube 114 in a stable manner, and the second support area 66 of the second end support 52 preferably receives the second end 112*b* of the first arcuate tube 112 in a stable manner.

In one embodiment, a third fastener assembly comprising a third fastening pin 72 and a third fastening pin end 74 is preferably utilized to secure the first end 114*a* of the second arcuate tube 114 within the second support space 66 formed between the first and second flanges 60, 62 of the first end support 50. Specifically, in the assembled position of the adjustable rod assembly 10, the first end 114*a* of the second arcuate tube 114 is positioned within the second support area 66, such that the apertures 116 of the first end 114*a* of the second arcuate tube 114 are generally aligned or in registry with the respective second apertures 60*b*, 62*b* of the first and second flanges 60, 62. The third fastening pin 72 and the third fastening pin end 74 are then inserted through the respective second apertures 60*b*, 62*b* of the first end support 50 and the apertures 116 of the first end 114*a* of the second arcuate tube 114. The third fastening pin 72 may be secured within the third fastening pin end 74 by any known conventional mechanisms, such as corresponding thread patterns, an adhesive, friction fit, an interference fit and the like. As such, the second arcuate tube 114, and more particularly the first end 114*a* of the second arcuate tube 114, is pivotably secured to the first end support 50.

Preferably, the second end 112*b* of the first arcuate tube 112 is pivotably secured to the second support area 66 of the second end support 52 in a similar manner. Specifically, a fourth fastening pin and a fourth fastening pin end of a fourth fastening assembly (not shown) engage the respective second apertures 60*b*, 62*b* of the first and second flanges 60, 62 of the second end support 52 and the apertures 116 of the second end 112*b* of the first arcuate tube 112 to pivotably secure the first arcuate tube 112 to the second end support 52. As such, pivotal movement of the curved rod assembly 100 is enabled.

In use, to obtain an assembled adjustable rod assembly 10, both the straight rod assembly 12 and the curved rod assembly 100 must be placed in assembled positions. To place the curved rod assembly 100 in the assembled position, the first end 112*a* of the first arcuate tube 112 is positioned within the second end 114*b* of the second arcuate tube 114, such that the first and second tubes 112, 114 are telescopingly configured. Also, the first end 114*a* of the second arcuate tube 114 is pivotably secured to the second support area 66 of the first end support 50, and the second end 112*b* of the first arcuate tube 112 is pivotably secured to the second support area 66 of the second end support 52.

To place the straight rod assembly 12 in the assembled position: the first end 14*a* of the first straight tube 14 is positioned within the second end 16*b* of the second straight tube 16, such that the first and second tubes 14, 16 are telescopingly configured and the second straight tube 16 is freely rotatable relative to the first straight tube 14; the connector portion 32 of the rod 22 of the tension mechanism 20 is fixedly secured within the first end 16*a* of the second straight tube 16 and at least a portion of the threaded portion 28 of the rod 22 extends from the second straight tube 16 into the first straight tube 14 where it is rotatably secured therein by the threaded bushing 38; the first end 16*a* of the second straight tube 16 is rotatably secured within the second end 44*b* of the coupler 44 such that the locking pin 36 of the connector 34 is positioned within the aperture 46*a* of the intermediate wall 46 of the coupler 44; the first end 44*a* of the coupler 44 is pivotably secured to the first end support 50; and the second end 16*b* of the second straight tube 16 is pivotably secured to the second end support 52.

Accordingly, in the assembled adjustable rod assembly 10, both ends of the curved rod assembly 100 (i.e., first end 114*a* of the second arcuate tube 114 and the second end 112*b* of the first arcuate tube 112) are pivotably secured to the first and second end supports 50, 52. Also, in the assembled adjustable rod assembly 10, one end of the straight rod assembly 12 (i.e., the second end 14*b* of the first straight tube 14) is pivotably secured to the second end support 52, while the other end of the straight rod assembly 12 is rotatably secured to the first end support 50. More particularly, while the coupler 44 is pivotably secured to the first end support 50, the second straight tube 16 remains rotatable relative to the first end support 50. Thus, the second straight tube 16 is rotatably secured to the first end support 50, such that rotational movement of the second straight tube 16 is enabled in the assembled position of the adjustable rod assembly 10.

Since both rod assemblies 12, 100 are secured to the first and second end supports 50, 52, any adjustment of the length L1 of the straight rod assembly 12 results in a similar adjustment of the overall length L2 of the curved rod assembly 100, and accordingly of the overall length of the entire adjustable rod assembly 10. Specifically, as the second straight tube 16 is rotated in either the first or second direction, causing movement of the first and second straight tubes 14, 16 either away from or toward each other, the first and second arcuate tubes 112, 114 will similarly move either away from or toward each other.

To install the assembled adjustable rod assembly 10 in a bathtub or shower stall (not shown), the assembly 10, with the straight rod assembly 12 and the curved rod assembly 100 both in their respective assembled positions, is positioned between the opposing support surfaces of the stall and the lengths L1, L2 of both rod assemblies 12, 100 are adjusted until the desired overall length of the adjustable rod assembly 10 is achieved. As described above, the length L2 of the curved rod assembly 100 is adjusted by sliding the first and second tubes 112, 114 either toward or away from each other until the initial desired length is achieved. Similarly, the length L1 of the straight rod assembly 12 is similarly adjusted by sliding the first and second straight tubes 14, 16 either toward or away from each other until the initial desired length is achieved.

The desired overall length of the adjustable rod assembly 10 is dependent upon the distance between the opposing support surfaces and is achieved when the rear face 56*a* of the base plate 56 (or the resilient pad 58 attached thereto) of each end support 50, 52 is proximate a respective opposing support surface. More preferably, the desired overall length of the adjustable rod assembly 10 is achieved when the rear face 56*a* of the base plate 56 or (the resilient pad 58 attached thereto) of each end support 50, 52 directly contacts or almost directly contacts a respective opposing support surface at generally the same height, such that the first and second straight tubes 14, 16 and the first and second arcuate tubes 112, 114 are generally horizontal in the mounted configuration.

Finally, once the assembled adjustable rod assembly 10 is properly positioned between the two opposing support surfaces, the second straight tube 16 can be manually rotated by a user to generate a tension or compressive force to be exerted by the adjustable rod assembly 10 upon the opposing support surfaces, such that the assembly 10 is maintained between the two opposing surfaces without the use of fasteners or adhesives. Specifically, when the assembled adjustable rod assembly 10 is positioned between the two opposing surfaces, the user manually rotates second straight tube 16 about its longitudinal axis X1, thereby extending the length L1 of the straight rod assembly 12. The length L2 of the curved rod assembly 100 is similarly extended, since the telescoping first and second arcuate tubes 112, 114 will naturally move away from each other as the first and second straight tubes 14, 16 do so.

Rotation of the second straight tube 16 is performed until the rear surface 56*a* of the base plate 56 or (the resilient pad 58 attached thereto) of each end support 50, 52 directly contacts a respective opposing support surface and a compressive or tensile force, generated by the tension mechanism 20, is applied or exerted against the opposing support surfaces. In one embodiment, upon rotation of the second straight tube 16, the threaded portion 28 of the rod 22 becomes flexed within the interior of the first straight tube 14, thereby causing the adjustable rod assembly 10 to exert a force against the opposing support surfaces and providing sufficient tension to maintain a secure fit between the surfaces. Preferably, a compressive or tensile force is also generated and exerted between the threads of bushing 38 and the threads of threaded portion 28 to maintain the position of bushing 38 along the threaded portion 28. As such, the adjustable rod assembly 10 is maintained between the two opposing surfaces without the use of fasteners or adhesives.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of installing an adjustable rod assembly, the method comprising the steps of:

a) providing an adjustable rod assembly including a first straight rod assembly having a first straight tube and a second straight tube, a second curved rod assembly having a first arcuate tube and a second arcuate tube, and first and second end supports, each of the first and second straight tubes and each of the first and second arcuate tubes having opposing first and second ends;

b) assembling the adjustable rod assembly by:

(i) telescopingly positioning the first end of the first straight tube in the second end of the second straight tube and telescopingly positioning the first end of the first arcuate tube in the second end of the second arcuate tube, (ii) pivotably securing the second end of the first straight tube and the second end of the first arcuate tube to the second end support, (iii) pivotably securing the first end of the second arcuate tube to the first end support, and (iv) rotatably securing the first end of the second straight tube to the first end support;

c) positioning the assembled adjustable rod assembly between opposing support surfaces;

d) adjusting a length of the assembled adjustable rod assembly such that a respective rear surface of each of the first and second end supports is proximate a respective one of the opposing support surfaces; and e) rotating the second straight tube about a longitudinal axis thereof until the respective rear surface of each of the first and second end supports directly contacts a respective one of the opposing support surfaces and the assembled adjustable rod assembly applies a compressive force against the opposing support surfaces.

2. The method of claim 1, wherein rotation of the second straight tube in a first direction about a longitudinal axis thereof extends the length of the assembled adjustable rod assembly and wherein rotation of the second straight tube in a second opposite direction about the longitudinal axis thereof reduces the length of the assembled adjustable rod assembly.

3. An adjustable rod assembly comprising:

a first straight rod assembly including:

a first straight tube having a first end and a second end, a second straight tube having a first end and a second end, the second end of the first straight tube being telescopingly received within the second end of the second straight tube and the second straight tube being rotatable relative to the first straight tube, and a third straight tube having a first end and a second end, the first end of the second straight tube being rotatably and telescopingly received within the second end of the third straight tube;

a second curved rod assembly including a first arcuate tube having a first end and a second end and a second arcuate tube having a first end and a second end, the first end of the first arcuate tube being telescopingly received within the second end of the second arcuate tube;

a first end support and a second end support, the first end of the third straight tube and the first end of the second arcuate tube being pivotably secured to the first end support at spaced apart positions, the second end of the first straight tube and the second end of the first arcuate tube being pivotably secured to the second end support at spaced apart positions;

a tension mechanism including a rod having a connector and a threaded portion, the connector being fixedly secured within the first end of the second straight tube and rotatably secured within the third straight tube, the threaded portion being rotatably secured within the first straight tube by a threaded bushing, wherein rotation of the second straight tube in a first direction about a longitudinal axis of the second straight tube causes the first straight tube and third straight tube to move away from each other and causes the first arcuate tube and the second arcuate tube to move away from each other, and wherein rotation of the second straight tube in a second opposite direction about the longitudinal axis of the second straight tube causes the first straight tube and third straight tube to move toward each other and causes the first arcuate tube and the second arcuate tube to move toward each other.

4. The adjustable rod assembly of claim 3, wherein the third straight tube includes an interior wall at a position between first and second opposing ends thereof, the interior wall including an aperture formed therethrough.

5. The adjustable rod assembly of claim 4, wherein the connector includes a pin which extends outwardly from a surface of the connector and which rotatably engages the aperture of the interior wall of the third straight tube, the engagement between the pin and the aperture enabling rotation of the second straight tube relative to the third straight tube and the first end support.

6. The adjustable rod assembly of claim 3, wherein at least a part of the threaded portion of the rod of the tension mechanism is flexible.

* * * * *